US009750972B1

(12) United States Patent
Liu et al.

(10) Patent No.: US 9,750,972 B1
(45) Date of Patent: Sep. 5, 2017

(54) FOLDING MECHANISM OF ROWING MACHINE

(71) Applicant: Dyaco International Inc., Taipei (TW)

(72) Inventors: Shih-Wei Liu, Taipei (TW); Hsuan-Fu Huang, Taipei (TW)

(73) Assignee: Dyaco International Inc., Taipei (TW)

( * ) Notice: Subject to any disclaimer, the term of this patent is extended or adjusted under 35 U.S.C. 154(b) by 0 days.

(21) Appl. No.: 15/148,983

(22) Filed: May 6, 2016

(30) Foreign Application Priority Data

Apr. 11, 2016 (TW) ..... 105111272 A

(51) Int. Cl.
*A63B 69/06* (2006.01)
*A63B 22/00* (2006.01)
*A63B 23/035* (2006.01)

(52) U.S. Cl.
CPC ..... *A63B 22/0076* (2013.01); *A63B 22/001* (2013.01); *A63B 23/03575* (2013.01); *A63B 2210/50* (2013.01); *Y10T 403/32377* (2015.01); *Y10T 403/32541* (2015.01)

(58) Field of Classification Search
CPC ..... A63B 22/0076; A63B 22/001; A63B 23/03575; A63B 2210/50; Y10T 403/32541; Y10T 403/32377; Y10T 403/32549; Y10T 403/32557; Y10T 403/32581
See application file for complete search history.

(56) References Cited

U.S. PATENT DOCUMENTS 8,062,238 B2 * 11/2011 Lindblad ..... A61H 1/0218 482/144
9,365,230 B2 * 6/2016 Cheng ..... B62B 7/008
2013/0144223 A1 * 6/2013 Hewitt ..... A61M 25/0021 604/246

* cited by examiner

*Primary Examiner* — Loan H Thanh
*Assistant Examiner* — Megan Anderson
(74) *Attorney, Agent, or Firm* — Donald E. Stout; Stout, Uxa & Buyan, LLP

(57) ABSTRACT

An embodiment of this invention discloses a folding mechanism of a rowing machine that comprises a first frame, a second frame, a saddle member, and a control member. A front of the second frame includes a guiding portion that comprises an operation cut and a storage cut. The saddle member fixes with a rear end of the first fame and straddles on the rear end of the first frame. The saddle member includes a slot, and the first frame pivotally connects with the second frame via a pivot of the saddle member. The control member is arranged below the first frame and includes a bar at its rear end. The rowing machine can be folded for storage or spread for operation by switching the bar into the storage cut or operation cut.

8 Claims, 8 Drawing Sheets

FOLDING MECHANISM OF ROWING MACHINE

CROSS-REFERENCE TO RELATED APPLICATIONS

The entire contents of Taiwan Patent Application No. 105111272, filed on Apr. 11, 2016, from which this application claims priority, are expressly incorporated herein by reference.

BACKGROUND OF THE INVENTION

1. Field of the Invention

The present invention relates to a rowing machine, and more particularly relates to a rowing machine having a folding mechanism.

2. Description of Related Art

An indoor rower or rowing machine is a machine used to simulate the action of watercraft rowing for the purpose of exercise or training for rowing.

Modern indoor rowers are often known as ergometers, which are devices measuring the amount of work performed. The indoor rower is calibrated to measure the amount of energy that the rower is using through the equipment.

The rowers may be folded for saving the space. For example, a Taiwan patent, publication number 320970, discloses a rower that includes a sliding structure and a front frame. The sliding structure pivotally couples with the front frame. When the sliding structure and the front frame are spread to an operable position, the rower can be used for simulating the action of watercraft rowing. A knob with a screw is used to fix the sliding structure with a first threaded hole so as to fasten the sliding structure at the operable position. The knob with the screw is needed to be detached from the first threaded hole and screwed to a second threaded hole so as to fasten the sliding structure at a storage position.

The conventional rower has disadvantages that the fixing by the knob with the screw may be not sufficient strong and the folding procedure is complicated and time-consuming.

SUMMARY OF THE INVENTION

In one general aspect, the present invention relates to a rowing machine having a folding mechanism.

According to an embodiment of the present invention, a folding mechanism of a rowing machine is provided with a first frame, a second frame, a saddle member, and a control member. A front end of the second frame has a guiding portion that comprises an operation cut and a storage cut. The saddle member fixes with a rear end of the first fame and straddles on a rear end of the first frame. The saddle member has a slot. The first frame pivotally connects with the second frame via a pivot of the saddle member. The control member is arranged below the first frame, a rear end of the control member having a rod. When the first frame and the second frame are spread, the rod is within the operation cut and passes through the slot of the guiding portion. When a force is exerted on the control member to make the rod leaving the operation cut and sliding into the storage cut, the second frame is folded to a storage position.

In an embodiment, when the second frame is folded to the storage position, the rod is within the storage cut and passes through the slot of the guiding portion; and when a force is exerted on the control member to make the rod leaving the storage cut and sliding into the operation cut, the second frame is spread to the working position.

In an embodiment, the folding mechanism further comprises a spool arranged below the first frame, wherein the control member can rotate around the spool.

In an embodiment, the folding mechanism further comprises a torsion spring, wherein the spool passes through the torsion spring, and the torsion spring includes a first end coupling a bottom of the first frame and a second end coupling the control member.

In an embodiment, the slot of the guiding portion includes an upper end and a lower end, and when the first frame and the second frame are spread to be parallel with each other, the rod of the control member is within the upper end of the slot and is within the operation cut.

In an embodiment, when the second frame is folded to be perpendicular to the first frame, the rod of the control member is within the upper end of the slot and is within the storage cut.

In an embodiment, when the first frame and the second frame are spread to be parallel with each other, the guider portion of the second frame is within the first frame.

In an embodiment, the folding mechanism further comprises a seat movably mounted on a track of the second frame and being capable moved forward and backward along the track.

In an embodiment, the guiding portion is arc-shaped.

DETAILED DESCRIPTION OF THE PREFERRED EMBODIMENT

Figure 1:
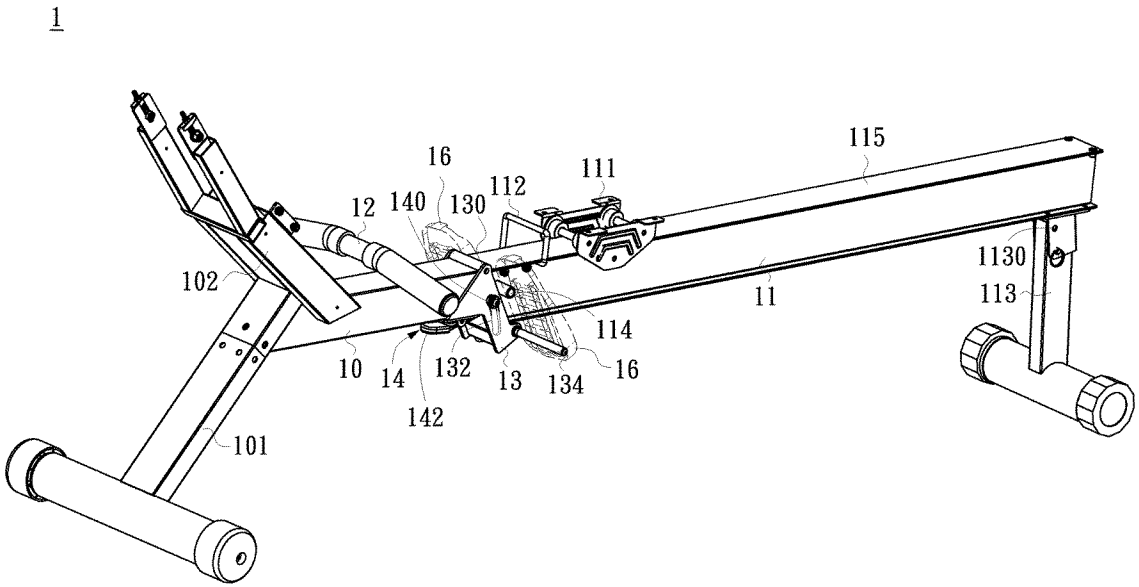
FIG. 1 is a perspective view showing a rowing machine at a working position according to a preferred embodiment of the present invention.

Embodiments of the invention are now described and illustrated in the accompanying drawings, instances of which are to be interpreted to be to scale in some implementations while in other implementations, for each instance, not. In certain aspects, use of like or the same reference designators in the drawings and description refers to the same, similar or analogous components and/or elements, while according to other implementations the same use should not. According to certain implementations, use of directional terms, such as, top, bottom, left, right, up, down, over, above, below, beneath, rear, front, clockwise, and counterclockwise, are to be construed literally, while in other implementations the same use should not. While the invention will be described in conjunction with these specific embodiments, it will be understood that it is not intended to limit the invention to these embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well-known process operations and components are not described in detail in order not to unnecessarily obscure the present invention. While drawings are illustrated in detail, it is appreciated that the quantity of the disclosed components may be greater or less than that disclosed, except where expressly restricting the amount of the components.

FIG. 1 is a perspective view showing a rowing machine at a working position according to a preferred embodiment of the present invention. Preferably, the rowing machine 1 comprises a first frame 10, a second frame 11, a handle 12, and a resistance device (not shown).

Referring to FIG. 1, the rowing machine 1 further comprises a seat 111 slidably mounted on a track 115 of the second frame 11, and the seat 111 can be moved forward and backward along the track 115. A left side wall and a right side wall of the second frame 11 may include a pivot 114, which pivotally couples with a pedal 16, respectively. The resistance device may include a magnetic-controlled roller, such as a flywheel. The magnetic-controlled roller may couples with the handle 12 via a belt (not shown). A user may pull the handle 12 to drive the flywheel to rotate.

When operating, the user sits on the seat 111 with his or her feet stepping on the pedals 16 and hands holding the handle 12. When the belt is pulled out by the user's hands via the handle 12, the seat 111 is moved backward along the track 115 of the second frame 11. In addition, a homing element (not shown) is capable of pulling the handle 12 via the belt (not shown) to its original position. When the handle 12 is drawn back to its original position, the belt pulls the user moving forward and thus pulls the seat 111 moving forward along the track 115.

Referring to FIG. 1, preferably, a front portion of the first frame 10 includes a front support 101, and a rear portion of the second frame 11 includes a rear support 113. The front support 101 and the rear support 113 can support the first frame 10 and the second frame 11. A rear end of the first frame 10 pivotally couples with the front end of the second frame 11 via a pivot 130, and a rear end of the second frame 11 pivotally couples with the rear support 113 via a pivot 1130. In addition, the front portion of the first frame 10 may include a post 102 and the resistance device is mounted with the post 102. In addition, a saddle member 13 is mounted on the rear end of the first frame 10 and straddles on the rear end of the first frame 10. The first frame 10 pivotally connects with the second frame 11 via the pivot 130 of the saddle member 13. The saddle member 13 may include a limiting rod 134 used for restricting the rotation angle of the pedal 16. The pedal 16 pivotally connects with the pivot 114, and the rotation angle of the pedal 16 is limited by the limiting rod 134, so that the operation of the pedal 16 can be more stable. The saddle member 13 can be produced by stamping, casting, or molding. If the user wants to fold the rowing machine 1, the rear support 113 is firstly folded to be parallel with the second frame 11, and then the second frame 11 is pulled up to be perpendicular to the first frame 10 via a grip 112. The following describes the detail of the folding mechanism and procedure.

FIGS. 2-7 are partially enlarged views showing the folding mechanism and the folding procedure according to the preferred embodiment of the present invention. For clarity, some components are drawn by dotted lines.

Figure 2:
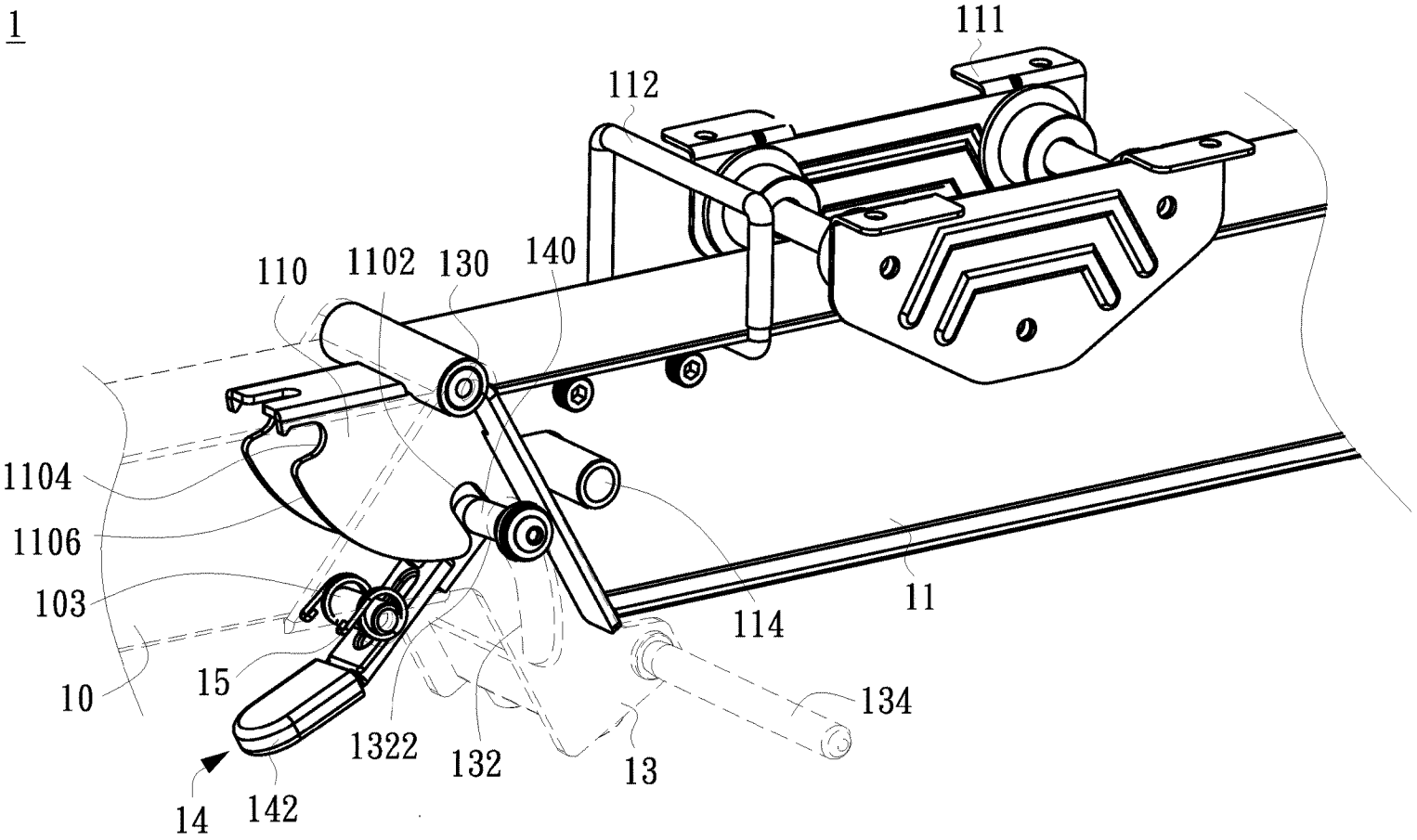
FIG. 2 is a partially enlarged view showing a folding mechanism of a rowing machine at a working position according to the preferred embodiment of the present invention.

As shown in FIGS. 1-2, the saddle member 13 fixes with the rear end of the first fame 10 and straddles on the rear end of the first frame 10. The saddle member 13 includes a slot 132, and the first frame 10 pivotally connects with the second frame 11 via the pivot 130 of the saddle member 13. A front of the second frame 11 includes a guiding portion 110. When the first frame 10 and the second frame 11 are spread to the working position, the first frame 10 is parallel with the second frame 11, and the guiding portion 110 is within the first frame 10. Preferably, the guiding portion is arc-shaped. In other embodiments of the present invention, the guiding portion 110 may be polygon-shaped or other arc-like configurations. Preferably, the guiding portion 110 includes an operation cut 1102, a storage cut 1104, and a cambered surface 1106. In addition, the first frame 10 may include a spool 103 arranged below the first frame 10, and the spool 103 passes through a torsion spring 15. The torsion spring 15 includes two ends, in which one end couples with the bottom of the first frame 10, and the other end couples with the control member 14. In addition, a front end of the control member 14 includes a touch portion 142, and a rear end of the control member 14 includes a bar 140. The bar 140 of the control member 14 passes through the slot 132, and the slot 132 limits and guides the moving path of the rod 140 of the control member 14. When the rowing machine 1 is at the working position, the first frame 10 is parallel to the second frame 11, and the rod 140 is placed in the operation cut 1102 of the guiding portion 110 and placed in an upper end 1322 of the slot 132 of the saddle member 13, so that the second frame 11 can be fixed and cannot be rotated around the pivot 130.

Figure 3:
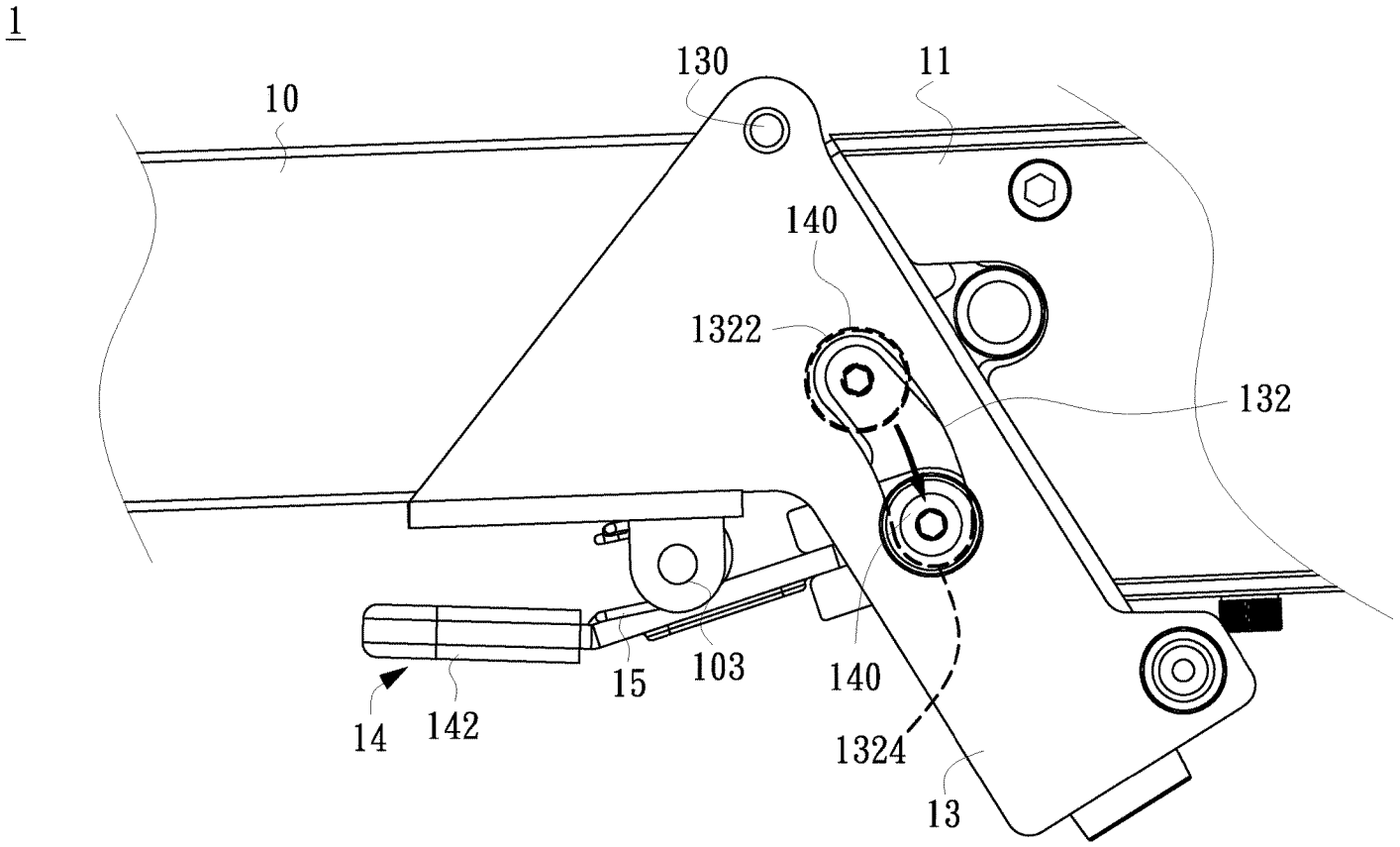
FIG. 3 is a partially enlarged view showing a folding mechanism of a rowing machine that is being folded by operating a control member according to the preferred embodiment of the present invention.
Figure 4:
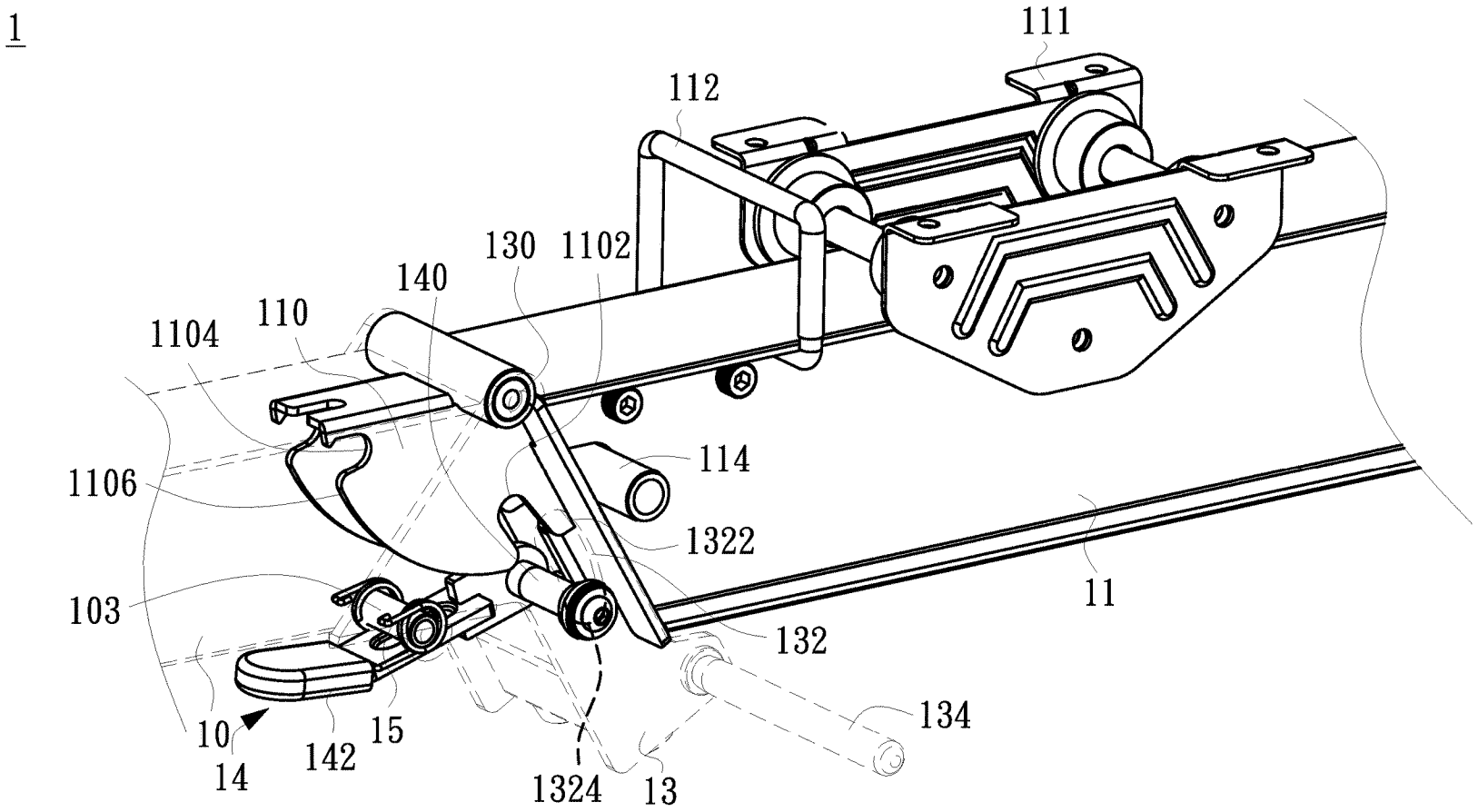
FIG. 4 is a partially enlarged view showing a folding mechanism of a rowing machine that is being folded by operating a control member according to the preferred embodiment of the present invention.

As shown in FIGS. 3 and 4, when the user wants to fold the rowing machine 1, he or she may lift the touch portion 142 of the control member 14, so that the rod 140 of the rear end of the control member 14 is moved downward and thus leaves the operation cut 1102 of the guiding portion 110, and the rod 140 leaves the upper end 1322 of the slot 132 and moves into a lower end 1324 of the slot 132.

Figure 5:
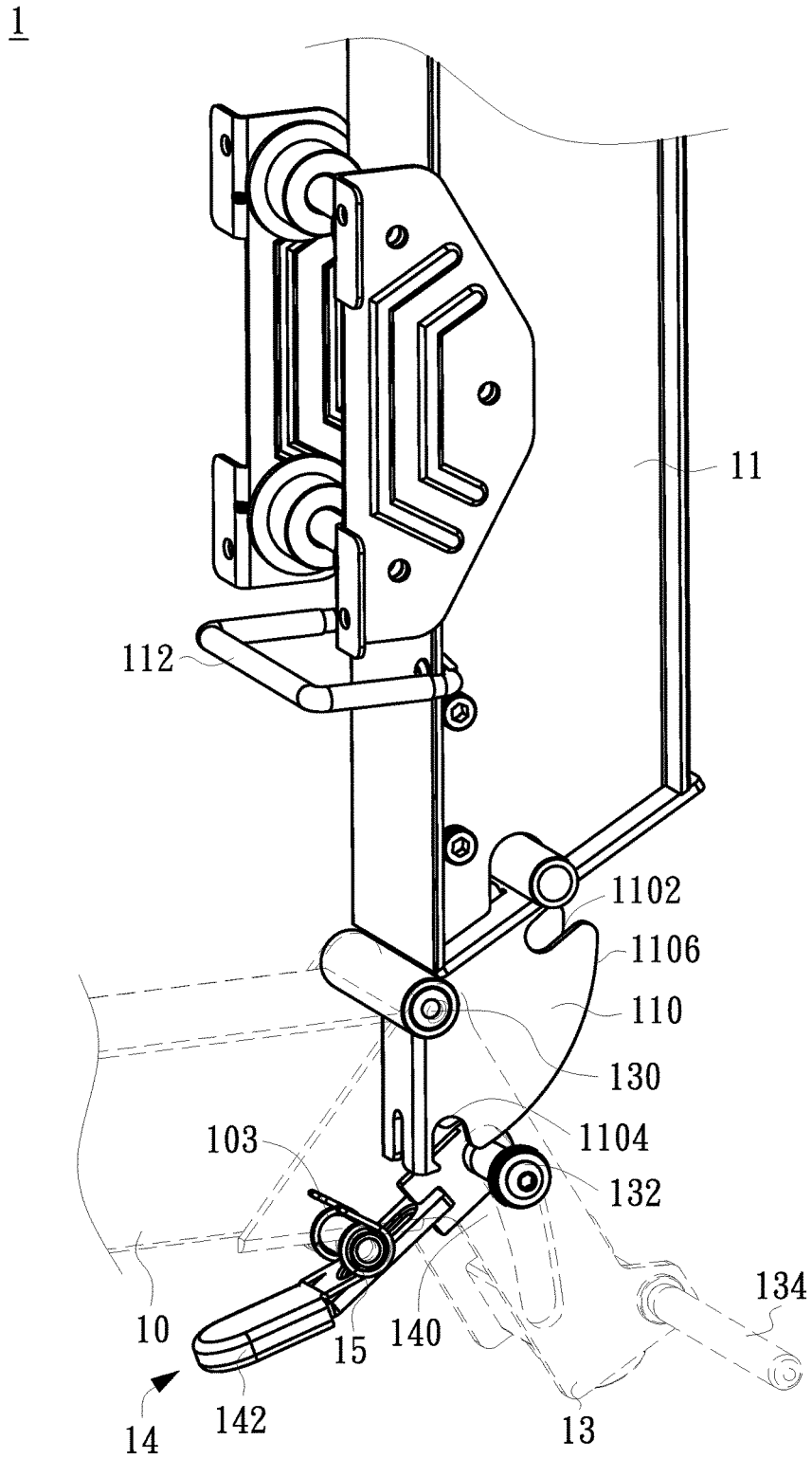
FIG. 5 is a partially enlarged view showing that a second frame is being folded to be essentially perpendicular to a first frame of a folding mechanism according to the preferred embodiment of the present invention.

Referring to FIG. 5, because the rod 140 of the control member 14 leaves the operation cut 1102 of the guiding portion 110 of the second frame 11, the second frame 11 can be rotated around the pivot 130. At this time, the user can pull up the second frame 12 via the grip 112 and thus make the second frame 11 to be perpendicular or approximately perpendicular to the first frame 10. When the second frame 11 is being pulled up, the torsion spring 15 provides a force to make the control member 14 rotating counterclockwise arounds the spool 103, and therefore the rod 140 of the rear end of the control member 14 is moved along and against the cambered surface 1106 of the guiding portion 110.

Figure 6:
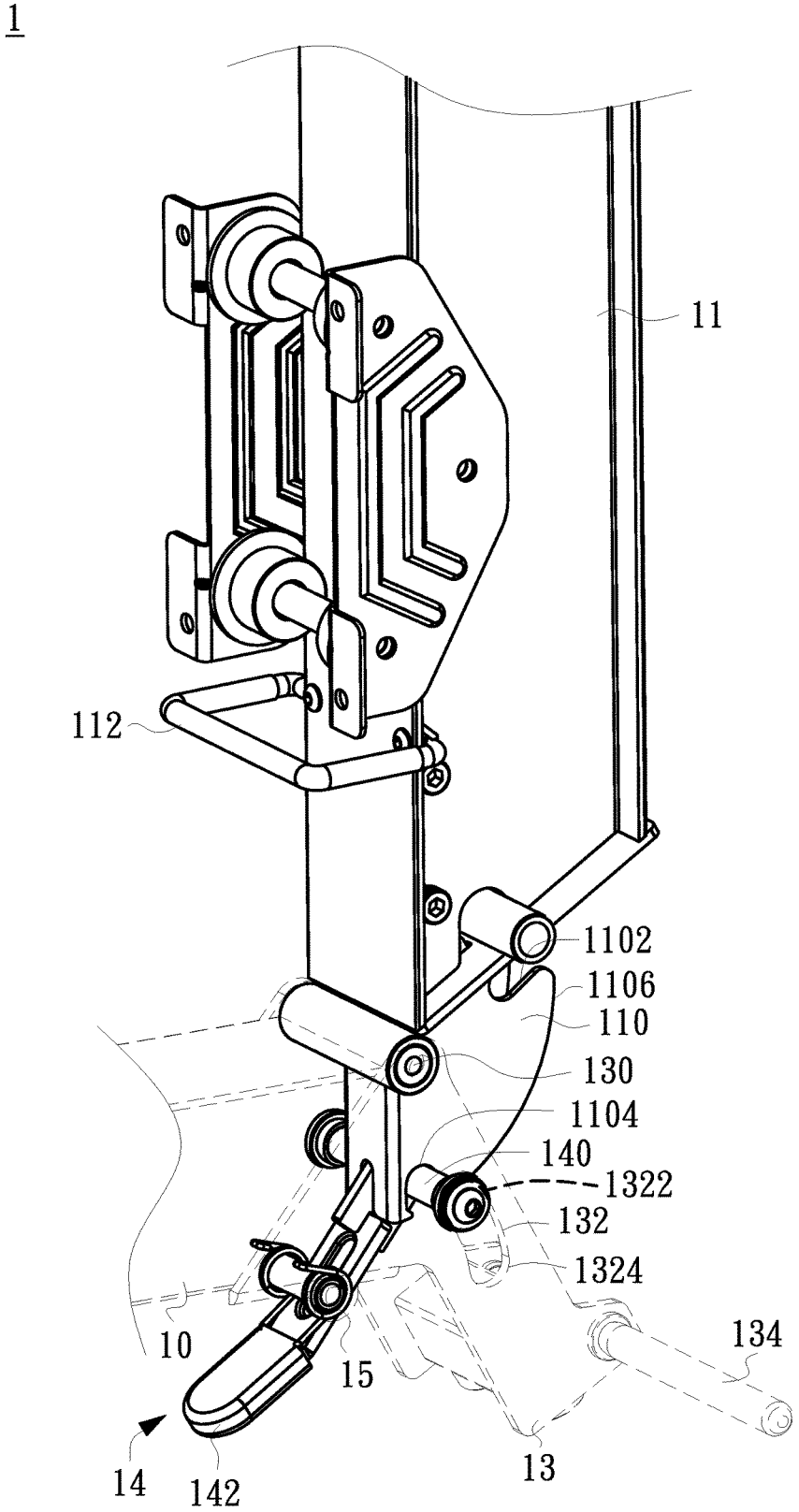
FIG. 6 is a partially enlarged view showing that a second frame is being folded to a storage position according to the preferred embodiment of the present invention.
Figure 7:
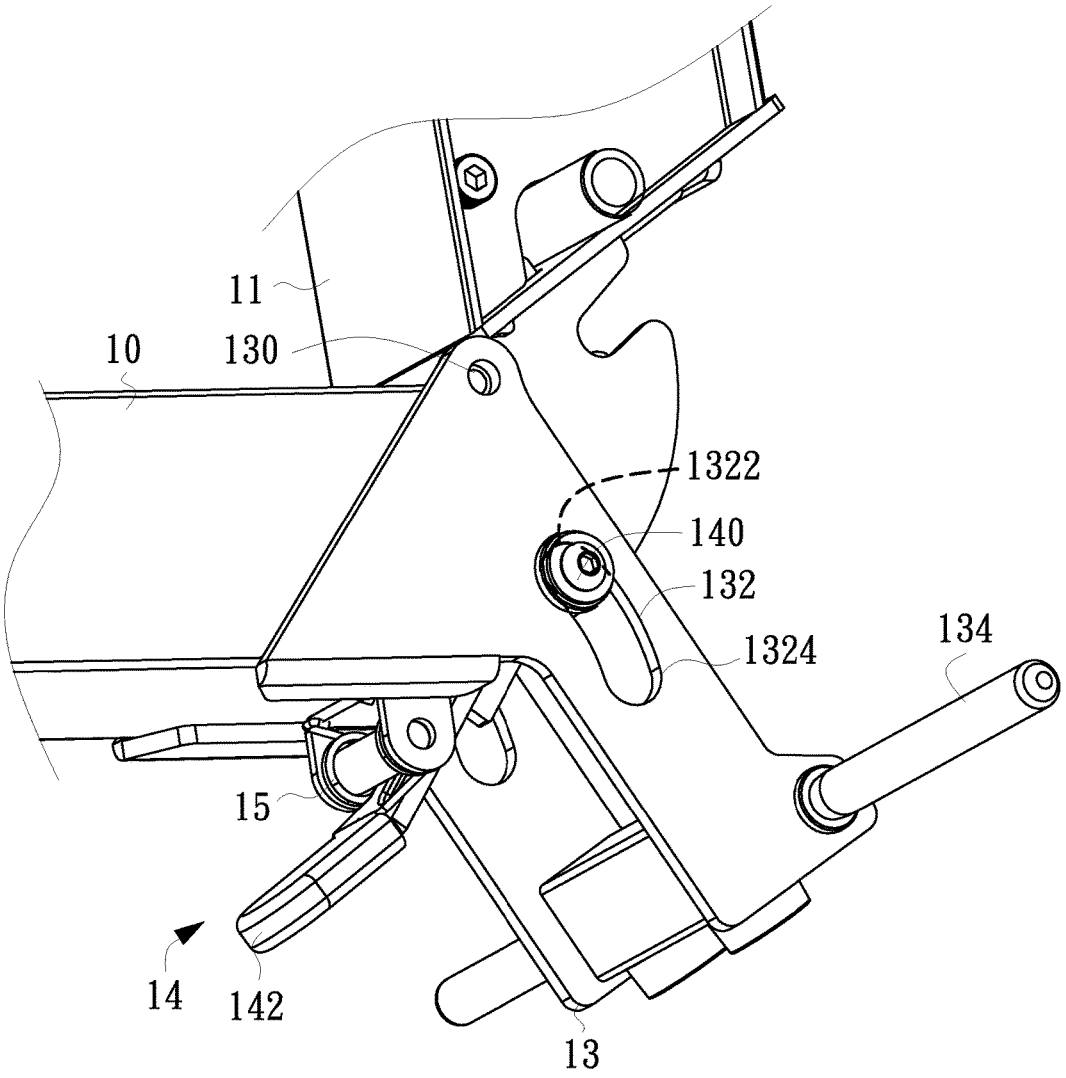
FIG. 7 is a partially enlarged view showing that a second frame is being folded to a storage position according to the preferred embodiment of the present invention.
Figure 8:
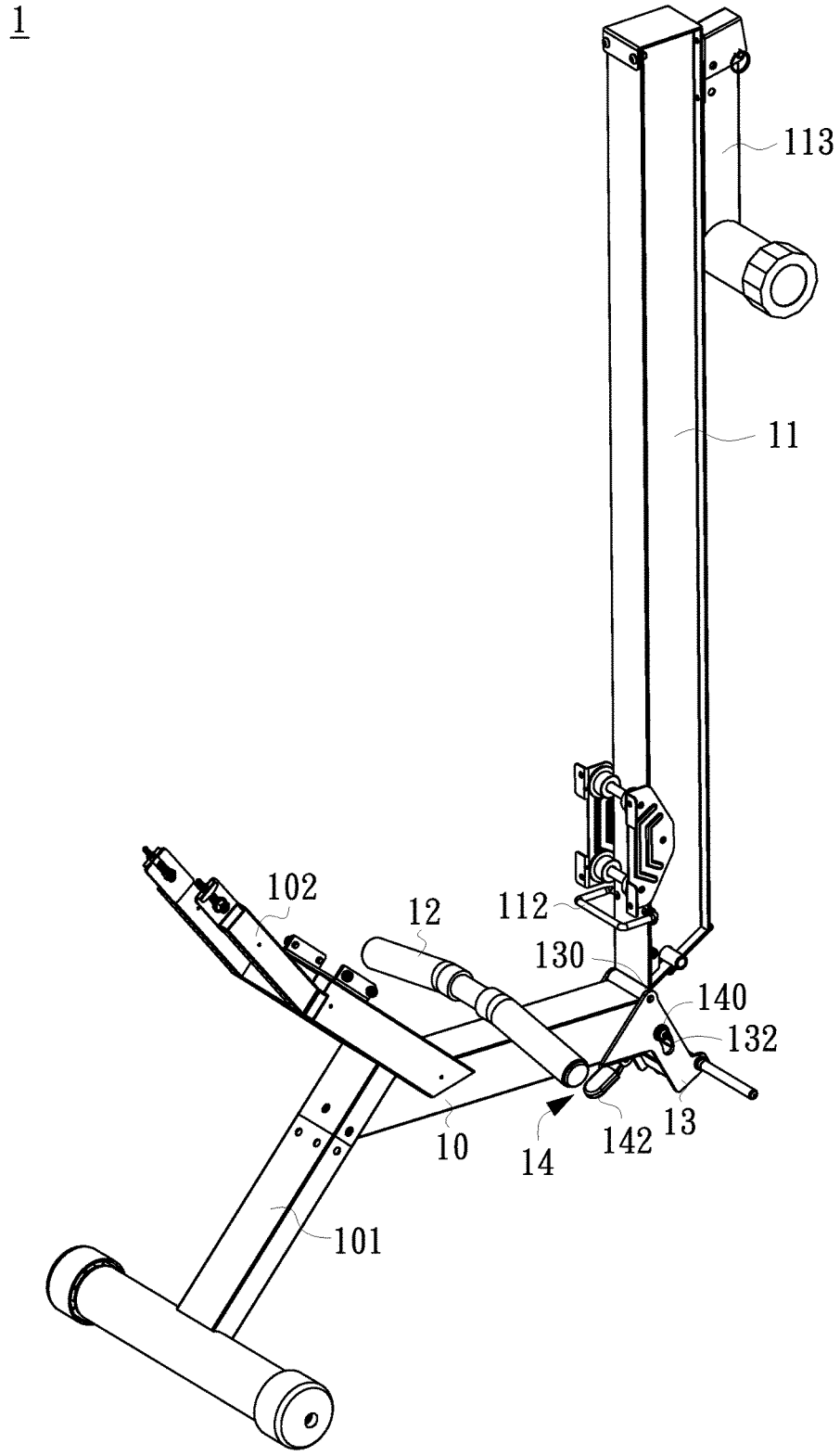
FIG. 8 is a perspective view showing that a second frame is being folded to a storage position according to the preferred embodiment of the present invention.

Referring to FIGS. 6 and 7, the torsion spring 15 provides a force to make the control member 14 rotating counterclockwise arounds the spool 103. When the second frame 11 is pulled up to be perpendicular to the first frame 10, i.e., the storage cut 1104 being right above the rod 140, the force provided by the torsion spring 15 will make the rod 140 of the control member 14 sliding into the storage cut 1104 of the guiding portion. Such that the second frame 11 is fixed and cannot be rotated around the pivot 130. FIG. 8 shows the rowing machine 1 is folded at a storage position.

Accordingly, the present invention provides a rowing machine having a folding mechanism to fold the rowing machine in a convenient, fast, and precise manner.

The intent accompanying this disclosure is to have each/all embodiments construed in conjunction with the knowledge of one skilled in the art to cover all modifications, variations, combinations, permutations, omissions, substitutions, alternatives, and equivalents of the embodiments, to the extent not mutually exclusive, as may fall within the spirit and scope of the invention. Corresponding or related structure and methods disclosed or referenced herein, and/or in any and all co-pending, abandoned or patented application(s) by any of the named inventor(s) or assignee(s) of this application and invention, are incorporated herein by reference in their entireties, wherein such incorporation includes corresponding or related structure (and modifications thereof) which may be, in whole or in part, (i) operable and/or constructed with, (ii) modified by one skilled in the art to be operable and/or constructed with, and/or (iii) implemented/made/used with or in combination with, any part(s) of the present invention according to this disclosure, that of the application and references cited therein, and the knowledge and judgment of one skilled in the art.

Conditional language, such as, among others, "can," "could," "might," or "may," unless specifically stated otherwise, or otherwise understood within the context as used, is generally intended to convey that embodiments include, and in other interpretations do not include, certain features, elements and/or steps. Thus, such conditional language is not generally intended to imply that features, elements and/or steps are in any way required for one or more embodiments, or interpretations thereof, or that one or more embodiments necessarily include logic for deciding, with or without user input or prompting, whether these features, elements and/or steps are included or are to be performed in any particular embodiment.

All of the contents of the preceding documents are incorporated herein by reference in their entireties. Although the disclosure herein refers to certain illustrated embodiments, it is to be understood that these embodiments have been presented by way of example rather than limitation. For example, any of the particulars or features set out or referenced herein, or other features, including method steps and techniques, may be used with any other structure(s) and process described or referenced herein, in whole or in part, in any combination or permutation as a non-equivalent, separate, non-interchangeable aspect of this invention. Corresponding or related structure and methods specifically contemplated and disclosed herein as part of this invention, to the extent not mutually inconsistent as will be apparent from the context, this specification, and the knowledge of one skilled in the art, including, modifications thereto, which may be, in whole or in part, (i) operable and/or constructed with, (ii) modified by one skilled in the art to be operable and/or constructed with, and/or (iii) implemented/made/used with or in combination with, any parts of the present invention according to this disclosure, include: (I) any one or more parts of the above disclosed or referenced structure and methods and/or (II) subject matter of any one or more of the inventive concepts set forth herein and parts thereof, in any permutation and/or combination, include the subject matter of any one or more of the mentioned features and aspects, in any permutation and/or combination.

Although specific embodiments have been illustrated and described, it will be appreciated by those skilled in the art that various modifications may be made without departing from the scope of the present invention, which is intended to be limited solely by the appended claims.

What is claimed is:

1. A folding mechanism of a rowing machine, comprising:

a first frame;

a second frame, a front end of the second frame having a guiding portion that comprises an operation cut and a storage cut;

a saddle member affixed to a rear end of the first frame, the saddle member having a slot, the first frame pivotally connecting with the front end of the second frame via a pivot of the saddle member; and a control member being arranged below the first frame, a rear end of the control member having a rod;

a spool arranged below the first frame, a middle portion of the control member pivoting about the spool, the rod of the control member being movable downwardly and upwardly upon application of a force on a front end of the control member;

whereby when the first frame and the second frame are in a working position, the rod is within the operation cut and passes through into the slot of the guiding portion; and to move the first frame and the second frame to a storage position, a force is exerted on the control member to move the rod from the operation cut to the storage cut.

2. The folding mechanism as recited in claim 1, wherein the slot of the guiding portion includes an upper end and a lower end, and when the first frame and the second frame are configured to be collinear with each other, the rod of the control member is within the upper end of the slot and is within the operation cut.

3. The folding mechanism as recited in claim 2, wherein when the second frame is folded to be perpendicular to the first frame, the rod of the control member is within the upper end of the slot and is within the storage cut.

4. The folding mechanism as recited in claim 1, wherein when the second frame is folded to the storage position, the rod is within the storage cut and passes through into the slot of the guiding portion; and to move the first frame and the second frame into the working position, a force is exerted on the control member to move the rod from the storage cut to the operation cut.

5. The folding mechanism as recited in claim 1, further comprising a torsion spring, wherein the spool passes through the torsion spring, and the torsion spring includes a first end coupling a bottom of the first frame and a second end coupling the control member.

6. The folding mechanism as recited in claim 1, wherein when the first frame and the second frame are configured to be collinear with each other, the guiding portion of the second frame is within the first frame.

7. The folding mechanism as recited in claim 1, further comprising a seat movably mounted on a track of the second frame and being configured to move forward and backward along the track.

8. The folding mechanism as recited in claim 1, wherein the guiding portion is arc-shaped.

* * * * *